US007267111B2

(12) United States Patent
Liskow

(10) Patent No.: US 7,267,111 B2
(45) Date of Patent: Sep. 11, 2007

(54) FUEL INJECTOR

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 262 days.

(21) Appl. No.: 11/121,505

(22) Filed: May 3, 2005

(65) Prior Publication Data

US 2005/0247803 A1 Nov. 10, 2005

(30) Foreign Application Priority Data

May 4, 2004 (DE) ..... 10 2004 021 920

(51) Int. Cl.
*F02M 37/08* (2006.01)
*F02M 37/04* (2006.01)

(52) U.S. Cl. ..... 123/498; 239/102.2

(58) Field of Classification Search ..... 123/498, 123/490, 478, 446; 239/102.2, 585.1; 310/316.03, 310/317

See application file for complete search history.

(56) References Cited

U.S. PATENT DOCUMENTS

| | | | | |
|---|---|---|---|---|
| 2,721,100 | A * | 10/1955 | Bodine, Jr. | 239/99 |
| 3,391,680 | A * | 7/1968 | Benson | 123/297 |
| 3,418,980 | A * | 12/1968 | Benson | 123/294 |
| 3,500,799 | A * | 3/1970 | Benson | 123/478 |
| 3,598,506 | A | 8/1971 | O'Neill | |
| 4,471,256 | A | 9/1984 | Igashira et al. | |
| 4,649,886 | A * | 3/1987 | Igashira et al. | 123/498 |
| 4,725,002 | A * | 2/1988 | Trachte | 239/102.2 |
| 6,172,445 | B1 | 1/2001 | Heinz et al. | |
| 6,478,013 | B1 * | 11/2002 | Boecking | 123/467 |
| 6,619,268 | B2 * | 9/2003 | Rueger et al. | 123/490 |
| 6,772,963 | B2 * | 8/2004 | Neretti et al. | 239/102.2 |
| 6,834,812 | B2 * | 12/2004 | Neretti et al. | 239/102.2 |
| 7,032,833 | B2 * | 4/2006 | Bocking | 239/102.2 |
| 7,059,538 | B2 * | 6/2006 | Maruyama et al. | 239/4 |
| 2005/0017096 | A1 * | 1/2005 | Bachmaier et al. | 239/584 |

FOREIGN PATENT DOCUMENTS

| | | |
|---|---|---|
| DE | 19519191 | 12/1996 |
| DE | 103 60 449 | 9/2004 |
| WO | WO 3085253 A1 * | 10/2003 |

* cited by examiner

*Primary Examiner*—Mahmoud Gimie
(74) *Attorney, Agent, or Firm*—Kenyon & Kenyon LLP

(57) ABSTRACT

Known fuel injectors have a valve housing in which an actuator and an hydraulic coupler are arranged, an electrical plug being provided on the valve housing for contact with a voltage source. The cables running from the plug to the actuator must be guided around the coupler to the actuator. It is disadvantageous that the compensating movements put heavy mechanical stress on the cables, so that a cable fracture as a result of material fatigue occurs after a predefined service life of the fuel injector, or that the solder or welding points of the cables tear. This leads to malfunctioning of the fuel injector. In the present fuel injector, the service life is increased by the provision of connections without cables. The earth pole of the actuator is electrically connected to the ground terminal of the plug in a cable-less manner, and the positive pole of the actuator is electrically connected to the positive terminal in a cable-less manner.

9 Claims, 1 Drawing Sheet

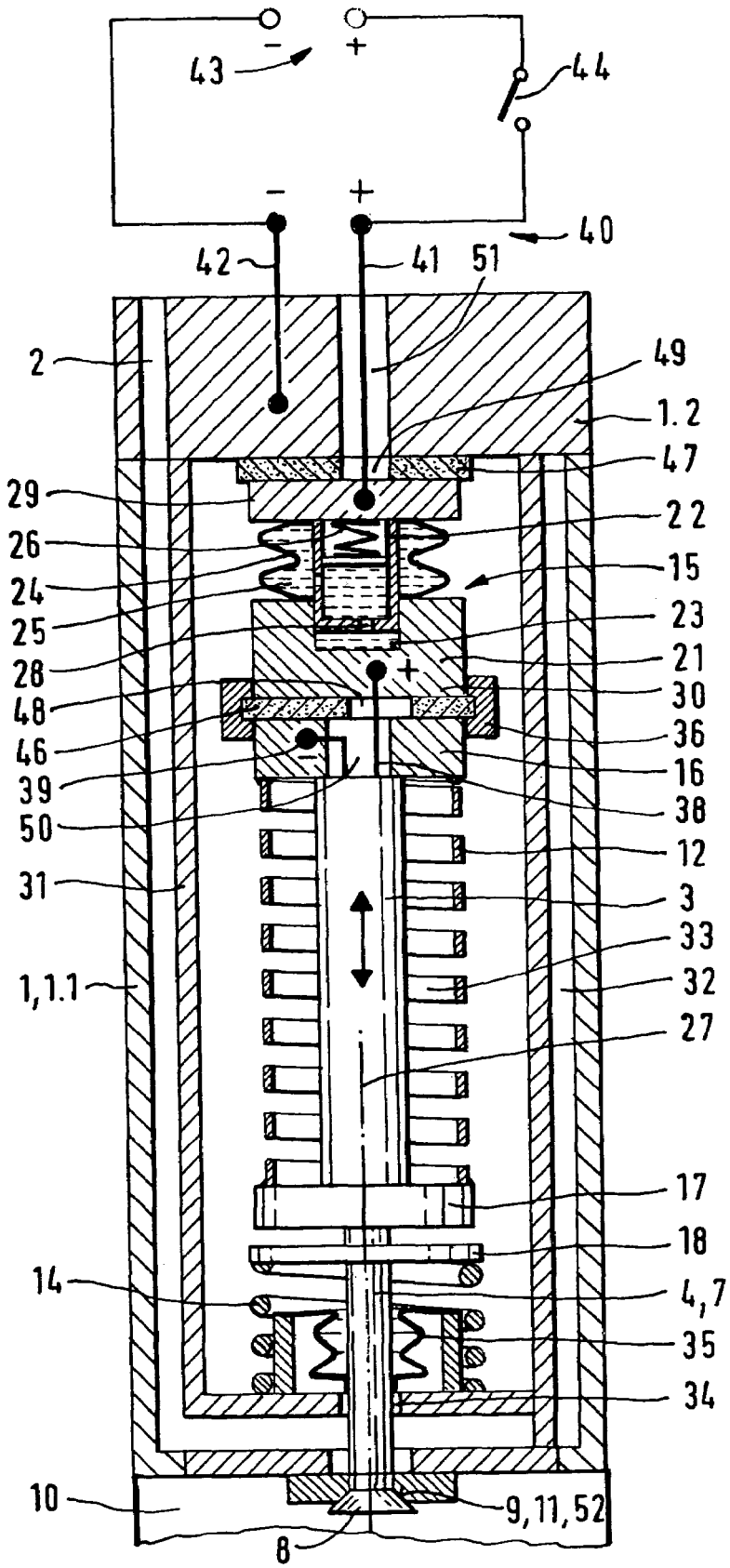
43
44
40
42
41
51
2
49
1.2
47
29
22
26
15
24
23
25
21
28
30
48
36
46
16
39
38
50
12
31
3
33
1,1.1
32
27
17
18
14
4,7
35
34
10
9,11,52
8

FUEL INJECTOR

BACKGROUND INFORMATION

A fuel injector having a valve housing in which a piezoelectric armature and an hydraulic coupler are arranged has already been proposed in German Patent Application No. 103 60 449, the piezoelectric actuator having a positive pole and an earth pole, an electrical plug with a positive terminal and a ground terminal being provided on the valve housing for the contacting with a voltage source. Via a cable in each case, the positive pole of the piezoelectric actuator is connected to the positive terminal of the plug, and the earth pole of the piezoelectric actuator is connected to the ground terminal of the plug. Since the hydraulic coupler between the valve housing and the actuator is arranged in a section of the fuel injector that faces the plug, the cables originating from the plug must be guided around the coupler to reach the actuator. Due to the fact that the hydraulic coupler executes thermally caused compensating movements, the cables cannot be taut, but must be non-tensioned by providing additional length. The cables are not allowed to be in contact with adjacent components, since the many compensating movements may otherwise cause them to fray over time. It is disadvantageous that the compensating movements put heavy mechanical stress on the cables, so that a cable fracture as a result of material fatigue will occur after a predefined service life of the fuel injector, or the solder or welding points of the cables will tear. This leads to malfunctioning of the fuel injector.

SUMMARY OF THE INVENTION

The fuel injector according to the present invention has the advantage that an improvement is achieved in a simple manner to the effect that the service life of the fuel injector is increased in that the earth pole of the actuator is electrically connected to the ground terminal of the plug, and the positive pole of the actuator is connected to the positive terminal in a cable-less manner. This prevents malfunctioning of the fuel injector due to a cable fracture. Since two cables are omitted, space is saved, so that the fuel injector is able to have a smaller design.

It is particularly advantageous if the earth pole of the actuator is electrically connected to the ground terminal of the plug via the valve housing and/or an actuator housing, since this utilizes an already existing electrically conductive connection in the fuel injector. Furthermore, the ground contacting of the actuator reduces electromagnetic interference radiation of the actuator.

In addition, it is advantageous if the positive pole of the actuator is electrically connected to the positive terminal by way of the hydraulic coupler, since in this way the current supply to the actuator is implemented via an existing electrically conductive connection.

According to an advantageous further development, the actuator is prestressed for compression in an actuator sleeve between an actuator top and an actuator base, and the earth pole of the actuator is electrically contacted to the actuator top, the actuator top being electrically connected to the actuator base via the actuator sleeve. The actuator base is electrically connected to the valve housing and/or the actuator housing via a valve needle, a shoulder of the valve needle and a restoring spring cooperating with the valve needle.

Furthermore, it is advantageous if the positive terminal of the plug is electrically connected to a head part of the hydraulic coupler, and the positive pole of the actuator is electrically connected to a foot part of the hydraulic coupler, the head part and the foot part of the hydraulic coupler in turn being interconnected in an electrically conducting manner via an elastic sealing element. This allows the current to be supplied by way of the hydraulic coupler.

It is advantageous if a first electrical insulation is provided between the hydraulic coupler and the actuator, and a second electrical insulation is provided between the hydraulic coupler and the valve housing since this prevents a short circuit.

BRIEF DESCRIPTION OF THE DRAWING

The FIGURE shows an exemplary embodiment of a fuel injector according to the present invention in a schematic representation.

DETAILED DESCRIPTION

The fuel injector is used in the so-called direct injection, for instance, and injects fuel such as gasoline or diesel into a combustion chamber of an internal combustion engine.

The fuel injector has a valve housing 1 with an input port 2 for the fuel. The valve housing includes a housing component 1.1 in the shape of a cup, for instance, and a housing lid 1.2 sealing cup-shaped housing component 1.1. Input port 2 is provided in housing lid 1.2, for example.

A schematically illustrated actuator 3 such as a piezoelectric or magneto-restrictive actuator is arranged in valve housing 1 for the axial adjustment of a valve needle 4.

Valve needle 4 is provided in valve housing 1 so as to be axially displaceable, and has, for instance, a needle shaft 7 facing actuator 3, and a valve-closure member 8 facing away from actuator 3. Actuator 3 transmits its movement to needle shaft 7 of valve needle 4, which causes valve-closure member 8 cooperating with a valve seat 9 to open or close the fuel injector. The fuel injector is a so-called outwardly opening valve, for instance, valve needle 4 executing a lift in the direction of a combustion chamber 10. When the fuel injector is closed, the entire circumference of valve-closure member 8 rests sealingly against valve seat 9 with line and surface contact, forming a sealing seat 11.

Piezoelectric actuator 3 is made up of a multitude of piezo-ceramic layers, which expand in the axial direction when an electrical voltage is applied. In the process, the so-called inverse piezoelectric effect is utilized in which electrical energy is converted into mechanical energy. The expansion of the piezo-ceramic layers caused by the application of the electrical voltage is transmitted to valve needle 4, valve needle 4 executing a lift of 40 to 50 micrometer, for instance. After the valve has been opened, actuator 3 shortens in response to the electrical voltage being switched off, and restoring spring 14 moves valve needle 4 back again in the direction of valve seat 9, closing the fuel injector.

To protect piezoelectric actuator 3 from tensile and bending stresses, it is arranged in an actuator sleeve 12 between an actuator top (head) 16 and an actuator base 17, actuator sleeve 12 being designed as so-called tube spring and made from a metal such as steel.

Actuator top 16 is arranged on a front-side end of actuator sleeve 12 facing away from valve needle 4 and integrally and/or frictionally connected to actuator sleeve 12, for instance by welding. Actuator base 17 is disposed at a front-side end, facing valve needle 4, of actuator sleeve 12 and likewise integrally and/or frictionally connected to actuator sleeve 12, for instance by welding.

Actuator sleeve 12 prestresses actuator 3 for compression between actuator top 16 and actuator base 17.

Needle shaft 7 of valve needle 4 has a shoulder 18 against which restoring spring 14 rests by one end so as to press needle shaft 7 of valve needle 4 against actuator base 17 of actuator sleeve 12 and to press valve-closure member 8 in the direction of valve seat 9.

Since actuator 3 and the other components of the fuel injector such as valve housing 1 expand to different degrees in response to temperature changes because of different thermal expansion coefficients, an hydraulic coupler 15 is provided, which compensates for the differences in the various linear expansions in order to ensure that the fuel injector with valve needle 4 will always implement the same lift regardless of the individual temperature of the fuel injector. No lift losses at which the lift of actuator 3 is not fully transmitted to valve needle 4 must occur, so that the lift of valve needle 4 is smaller than the lift of actuator 3.

Hydraulic coupler 15 is arranged between housing lid 1.2 and actuator top 16 of actuator sleeve 12, for instance.

Hydraulic coupler 15 includes a cup-shaped cylinder 21, for example, and a piston 22 which is axially displaceable in cup-shaped cylinder 21. A so-called coupler gap 23 is present between cup-shaped cylinder 21 and piston 22. Starting from cup-shaped cylinder 21, an elastic sealing element 24, which is configured as convoluted bellows and made of metal, extends up to piston 22. Elastic sealing element 24 encloses a coupler volume 25, which is connected to coupler gap 23 via the fluid by way of a throttle element 28. Coupler volume 25 and coupler gap 23 are filled with a fluid such as fuel or a second medium such as silicon oil, for instance. The pressure in the fluid of coupler volume 25 is increased with the aid of a spring element 26, for example, in that spring element 26 exerts a pressure force on elastic sealing element 24 from the outside, or is provided within elastic sealing element 24, for instance in piston 22, and exerts a pressure force on the fluid of coupler volume 25. For instance, piston 22 has a cavity which is connected to coupler gap 23 via throttle element 28, and which is connected to the circumference of piston 22 via a flow opening.

In displacement processes acting rapidly on hydraulic coupler 15, for instance the expansion of actuator 3 in response to an electrical voltage supply, hydraulic coupler 15 reacts as extremely rigid component since barely any fluid is able to flow out of coupler gap 23 through throttle element 28 into coupler volume 25 within the short period of time. Since coupler gap 23 thus remains constant in this situation, the lift of actuator 3 is transmitted to valve needle 4 in its entirety.

In displacement processes that act slowly on hydraulic coupler 15, such as the expansion in response to temperature changes, coupler gap 23 becomes smaller or larger since the fluid has enough time to flow out of or into coupler gap 23 via throttle element 28.

Cylinder 21 of hydraulic coupler 15 faces actuator 3, for instance, and piston 22 of hydraulic coupler 15 faces housing lid 1.1, or vice versa. The part of hydraulic coupler 15 facing housing lid 1.1 forms a head part 29, and the part facing actuator 3 forms a foot part 30 of hydraulic coupler 15.

Hydraulic coupler 15, actuator 3 with actuator sleeve 12, and valve needle 4 are arranged concentrically with respect to a valve axis 27, for instance.

Actuator sleeve 12 and hydraulic coupler 15 are, for instance, centered and fixed relative to one another, for example with the aid of an extrusion coat 36, which begins at actuator top 16 and extends to foot part 30 of hydraulic coupler 15.

To encapsulate actuator 3 and hydraulic coupler 15 with respect to fuel, an actuator housing 31 which hermetically surrounds actuator 3 and hydraulic coupler 15 and seals them from the fuel, is provided in valve housing 1. Actuator housing 31 has a cylindrical design, for example, and divides the interior space of valve housing 1 into a pressure chamber 32 loaded with fuel and connected to input port 2 via the fluid, and an actuator chamber having actuator 3 and hydraulic coupler 15. Actuator housing 31 is arranged in valve housing 1 in a concentric manner, for example, and rests against valve housing 1 at the front-side ends. For example, on the front side facing housing lid 1.2, actuator housing 31 is connected to housing lid 1.2 in an integral and/or non-positive manner, for instance by soldering. Starting from actuator base 17, needle shaft 7 of valve needle 4 extends in actuator chamber 33 in the direction facing away from actuator 3 and projects through actuator housing 31 into pressure chamber 32 through an opening 34; opening 34 is sealed by an elastic seal 35, so that no fuel is able to travel from pressure chamber 32 into actuator chamber 33. Seal 35 is designed as elastic convoluted bellows, for instance, which is made of metal, for example, and extends in an annular manner from needle shaft 7 to actuator housing 31.

Restoring spring 14 rests against shoulder 18 of valve needle 4 via its one end, and against actuator housing 31 by its other end.

Actuator 3 has a positive pole 38 and an earth pole 39, which is the electrical negative pole. Provided on valve housing 1, for instance on housing lid 1.2, is a two-pole electrical plug 40, for example, which has a positive terminal 41 and a ground terminal 42 for the contacting with an external voltage source 43. Depending on the setting of a high-power switch 44, either a high voltage of voltage source 43 or no voltage is applied at plug 40. High-power switch 44 is connected to a positive pole of voltage source 43. Voltage source 43 is a transformer, for example, which, for instance, raises a 12V on-board voltage of a vehicle to a high voltage.

According to the present invention, earth pole (39) of actuator (3) is electrically connected to ground terminal (42) of plug (40) in a cable-less manner, and positive pole (38) of actuator (3) is electrically connected to positive terminal (41) of plug 40 in a cable-less manner. Because of the cable-free connection, cable breaks, which would lead to malfunctioning of the fuel injector, are prevented.

According to an advantageous embodiment, earth pole 39 of actuator 3 is electrically connected to ground terminal 42 of plug 40 via actuator housing 31 and/or valve housing 1. This reduces the electromagnetic interference radiation of actuator 3.

Positive pole 38 of actuator 3 is electrically contacted by positive terminal 41 via hydraulic coupler 15, for instance. According to this circuit arrangement, the current is fed from plug 40 to actuator 3 via hydraulic coupler 15.

For example, earth pole 39 of actuator 3 is in electrical contact with actuator top 16, actuator top 16 being connected to actuator base 17 by way of actuator sleeve 12. Actuator base 17 in turn is electrically connected to actuator housing 31 via needle shaft 7 of valve needle 4, shoulder 18 of valve needle 4 and restoring spring 14 resting against shoulder 18.

Positive terminal 41 of plug 40 is electrically connected to head part 29 of hydraulic coupler 15, for instance, and positive pole 38 of actuator 3 to a foot part 30 of hydraulic coupler 15.

Head part 29 and foot part 30 of hydraulic coupler 15 are connected to one another in an electrically conducting manner by way of elastic sealing element 24.

Provided between hydraulic coupler 15 and actuator 3 is a first electrical insulation 46, and provided between hydraulic coupler 15 and valve housing 1 is a second electrical insulation 47 so as to prevent a short circuit between positive pole 38 and earth pole 39 of actuator 3 or between positive terminal 41 and ground terminal 42 of plug 40. Insulations 46, 47 are in the shape of disks, for example, and made of ceramic or some other electrically insulating material.

Positive pole 38 of actuator 3 extends, for instance, through a through hole 50 in actuator top 16 and projects through first electrical insulation 46 through a first opening 48 so as to provide contacting with foot part 30 of hydraulic coupler 15. Positive terminal 41 of plug 40 runs through a connecting duct 51 in housing lid 1.2 and projects through second electrical insulation 47, for instance through a second opening 49, so as to provide contacting with head part 29 of hydraulic coupler 15.

Second insulation 47 may also be embodied as piezoceramic for analyzing the power profile of actuator 3 and utilizing it to regulate the injection.

In valve housing 1, the fuel is guided from input port 2 into pressure chamber 32 to valve-closure member 8 upstream from sealing seat 11. When the fuel injector is opened, valve-closure member 8 lifts off from sealing seat 11, thereby opening a connection to combustion chamber 10 of the internal combustion engine, so that fuel is flowing into combustion chamber 10 by way of an annular discharge gap 52 formed between valve-closure member 8 and valve seat 9. The greater the lift of valve needle 4 in the opening direction, the larger discharge gap 52 becomes and the more fuel will be injected into combustion chamber 10 per time unit.

What is claimed is:

1. A fuel injector comprising:

a valve housing;

an hydraulic coupler situated in the valve housing;

an actuator situated in the valve housing, the actuator having a positive pole and an earth pole; and an electric plug having a positive terminal and a ground terminal, the plug being situated on the valve housing for a contacting with a voltage source, wherein the earth pole of the actuator is electrically connected to the ground terminal of the plug in a cable-less manner, and the positive pole of the actuator is electrically connected to the positive terminal of the plug in a cable-less manner.

2. The fuel injector according to claim 1, wherein the earth pole of the actuator is electrically connected to the ground terminal of the plug via at least one of the valve housing and an actuator housing.

3. The fuel injector according to claim 1, wherein the positive pole of the actuator is electrically connected to the positive terminal of the plug via the hydraulic coupler.

4. The fuel injector according to claim 1, wherein the actuator is pre-loaded for compression in an actuator sleeve between an actuator top and an actuator base, and the earth pole of the actuator is in electrical contact with the actuator top, the actuator top being electrically connected to the actuator base via the actuator sleeve.

5. The fuel injector according to claim 4, further comprising a valve needle and a restoring spring cooperating with the valve needle, and wherein the actuator base is electrically connected to at least one of the valve housing and an actuator housing via the valve needle and the restoring spring.

6. The fuel injector according to claim 1, wherein the positive terminal of the plug is electrically connected to a head part of the hydraulic coupler, and the positive pole of the actuator is electrically connected to a foot part of the hydraulic coupler.

7. The fuel injector according to claim 6, wherein the head part and the foot part of the hydraulic coupler are connected to one another in an electrically conductive manner via an elastic sealing element.

8. The fuel injector according to claim 1, further comprising a first electrical insulation situated between the hydraulic coupler and the actuator, and a second electrical insulation situated between the hydraulic coupler and the valve housing.

9. The fuel injector according to claim 1, wherein the hydraulic coupler is situated between the valve housing and the actuator, in a section of the fuel injector facing the plug.

* * * * *